United States Patent [19]

Henning

[11] Patent Number: 4,596,061

[45] Date of Patent: Jun. 24, 1986

[54] LIQUID-VACUUM WASHER FOR HARD SURFACES

[76] Inventor: John J. Henning, 910 Crestview, Palatine, Ill. 60007

[21] Appl. No.: 693,630

[22] Filed: Jan. 22, 1985

[51] Int. Cl.[4] ..... A47L 7/00

[52] U.S. Cl. ..... 15/322; 15/401

[58] Field of Search ..... 15/321, 322, 401

[56] References Cited

U.S. PATENT DOCUMENTS

| | | | |
|---|---|---|---|
| 954,541 | 4/1910 | Raymond et al. | 15/401 |
| 2,292,435 | 8/1942 | Crites | 15/401 X |
| 3,538,535 | 11/1970 | Ginsburgh et al. | 15/322 X |
| 3,711,891 | 1/1973 | Conway | 15/322 X |
| 3,992,747 | 11/1976 | Hufton | 15/322 X |
| 4,164,055 | 8/1979 | Townsend | 15/401 X |

FOREIGN PATENT DOCUMENTS

| | | | |
|---|---|---|---|
| 114926 | 8/1984 | European Pat. Off. | 15/322 |

*Primary Examiner*—Chris K. Moore

*Attorney, Agent, or Firm*—Charles F. Lind

[57] ABSTRACT

A spray-vacuum tool is disclosed for cleaning hard nonabsorbent surfaces, of varying smoothness or roughness and of varying materials including composition or ceramic tile, cement block, or even glass. The tool has a housing defining an interior cavity, and a partition divides the cavity into adjacent liquid and vacuum chambers each open to an open housing face. A pair of squeegees project beyond the open housing face from opposite housing sides paralleling the partition; and a pair of end guides also project beyond the open housing face from the other interconnecting housing sides, but with somewhat less projection than the squeegees have. The end guides extend slightly beyond the squeegees and the ends of each squeegee extend substantially up against the end guides. The end guides have flat edges designed to ride on the surface to be cleaned; and the squeegees then also ride against the same surface, but are somewhat flexed. This housing-squeegee-end guide containment of the chambers is immediately adjacent the surface to be cleaned. Nozzles in the liquid chamber operate to spray cleaning liquid directly against the same surface; and means including a control valve connect a high pressure source of such liquid to the nozzles. A hollow wand swiveled at one end to the housing connects the vacuum chamber with an appropriate source of vacuum and also serves as the tool handle. A brush also is in the liquid chamber immediately adjacent the squeegee. The end guides are mounted to swivel about axes extended parallel to the squeegees to allow tool rocking on the surface to be cleaned without having a vacuum break.

13 Claims, 8 Drawing Figures

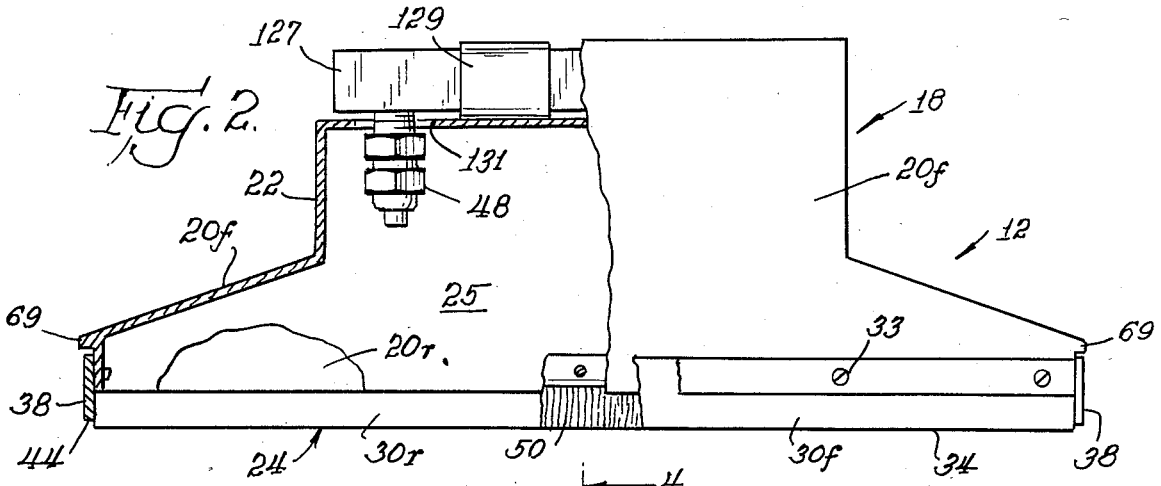
Fig. 2.
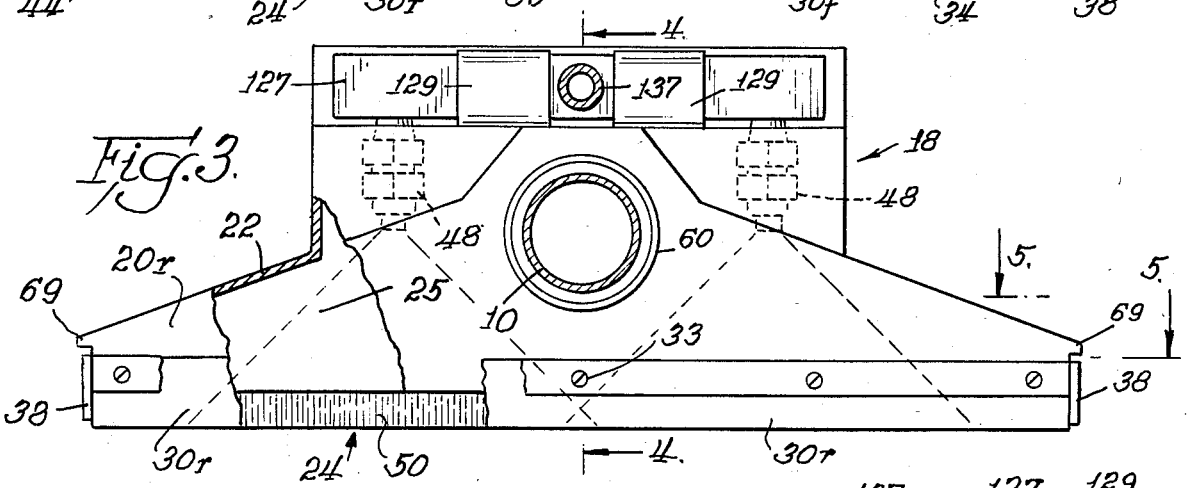
Fig. 3.
Fig. 5.
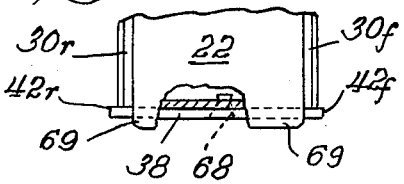
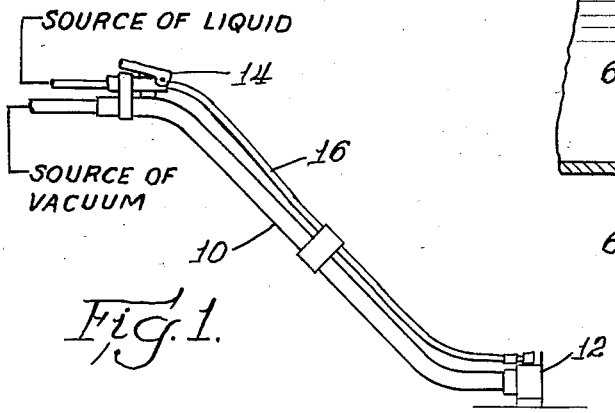
Fig. 1.
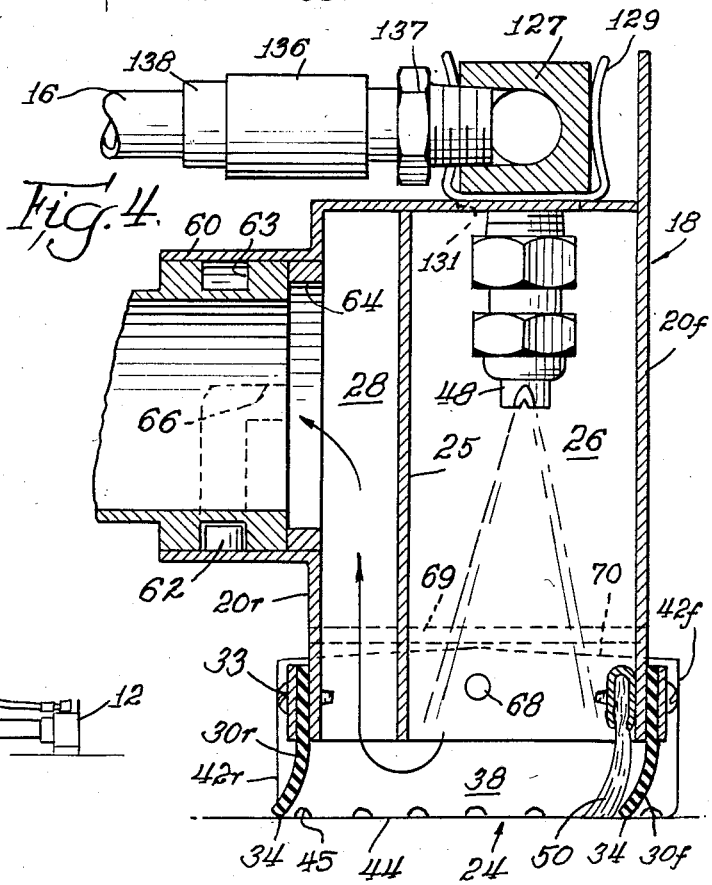
Fig. 4.

LIQUID-VACUUM WASHER FOR HARD SURFACES

RELATED INVENTIONS AND COPENDING APPLICATIONS

Two other applications for patents are being filed concurrently herewith for my related inventions: respectively entitled Liquid-Vacuum Washer for Walls, which relates to a tool specifically designed to clean walls Ser. No. 693,625; and Liquid-Vacuum Washer for Baseboard Corner, which relates to a tool specifically designed to clean the interior baseboard corner between the floor and wall Ser. No. 693,642.

BACKGROUND OF THE INVENTION

Commercial cleaning services for offices or the like are generally considered a very high labor intensive industry. Consequently, every labor saving device could represent a significant increase of productivity, and a resultant improved profit for anyone in such a business.

One device used to help clean carpets is the "stean cleaner"; using some type of cleaning liquid that is applied to the carpet and a tool that is moved back and forth on the surface and connected to a source of vacuum so as to draw excess liquid out of the carpet. Devices of this type are referred to herein as sppray-vacuum systems. The tool used on carpets has spaced generally flat surfaces that ride flush on the top of the carpet, and that define therebetween a slot open to the carpet and connected to the source of vacuum. The cleaning liquid is frequently sprayed directly onto the carpet, from outside the tool.

While the above-described tool works well on carpets generally, it does not work well for cleaning bare floors, such as exposed tile or cement; and accordingly different tool concepts have been proposed for this. However, they generally have been wanting. Some tools, for example, are effective in moving in one direction only; so that repeated back and forth cleaning passes are needed in order to effectively clean the surface or to draw away the excess liquid. Most systems apply the cleaning liquid in the open atmosphere so that it can end up beyond the areas intended. Some devices apply the liquid by rolling or rubbing it on the surface, so that they are slow or are not effective in reaching and cleaning the bottoms of holes or grooves such as are common in patterned tile or cement blocks, or in grout seams. Some systems or tools are just too bulky to be moved about freely and into hard-to-reach locations, such as against the wall or against or under furniture.

Of concern is the ability to use the spray-vacuum system on a wide range of types of surfaces, with a reasonable number of separate tool pieces, and at a reasonable investment of equipment. If a specialized tool is used, it should be as multi-functional as possible and/or be interchangable with other tools and operated off the same basic spray-vacuum system.

Of particular concern is the ability to clean hard nonabsorbent surfaces, such as composition or ceramic tile, cement, or even glass, of varying degrees of smoothness; and even a surface disposed in a vertical plane where liquid run-off and streaking down the surface normally is a continuing problem. Also, the somewhat porous rough surfaces of cement block normally need extra liquid and deep penetration of the liquid to be effectively cleaned, and this liquid again must be drawn away to avoid messy streaks or the like.

On the whole, known spray-vacuum tools for this purpose: (1) provide poor cleaning, in that much of the dirt and liquid remains on the surface even after being sprayed and vacuumed; (2) are messy with excess liquid spraying beyond the area to be cleaned; and (3) are slower that expected with the consequential reduction in the anticipated productivity.

SUMMARY OF THE INVENTION

This invention relates to a tool to be used with a liquid spray-vacuum cleaning system, and is particularly effective for cleaning walls and/or floors, of even or uneven surfaces, and of varying materials including composition or ceramic tile, cement block, or even glass.

A basic object of thus invention is to provide a tool that can be used without messy spills of cleaning liquid beyond that area intended to be cleaned, to ease in the cleanup and to avoid damaging nearby items of furniture or the like.

Another object of this invention is to provide a cleaning tool that is particularly effective in drawing out dirt or the like by blasting it loose from the surface with a high pressure spray in a containment of the tool housing cavity, by mechanically brushing the surface to even further dislodge the dirt, and drawing away the spray mist and dirt held in suspension therewith via the same containment cavity.

Yet another object of this invention is to provide a cleaning tool that can be operated in both directions of a back and forth stroke, so as to be fast but effective; and moreover that can be operated in close working quarters including right up to the adjacent floor or wall, so as to minimize any required hand touchup cleaning.

Yet another object of this invention is to provide a cleaning tool that is manually supported at the end of a wand in the spray-vacuum system, and that is interchangable with other tools of the related system for increased effectiveness and economy.

A specific object of this invention is to provide a wand-supported tool that can be manipulated with reasonable degrees of wand angling freedom, without breaking the vacuum draw between the tool and floor and interrupting the cleaning, and thereby requiring repeated time-consuming cleaning passes over the surface in order to effectively clean it.

BRIEF DESCRIPTION OF THE DRAWING

FIG. 1 is a side elevational view of a wand-held tool used with a liquid-vacuum cleaning system, and showing a tool mounted thereon;

FIGS. 2 and 3 are enlarged front and rear elevational views, respectively, of the improved tool of FIG. 1, each shown partly broken away and in section for clarity of disclosure;

FIG. 4 is an enlarged sectional view, as seen from line 4—4 in FIG. 3;

FIG. 5 is a sectional view, as seen from line 5—5 in FIG. 3;

DETAILED DESCRIPTION OF THE INVENTION

Figure 8:
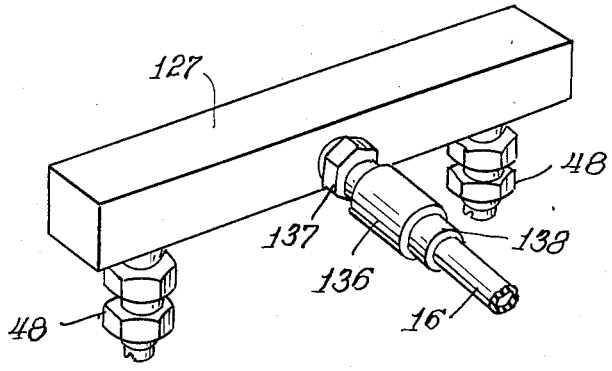
FIG. 8 is a perspective view of the spray nozzle manifold and disconnect couplng used in the tools disclosed herein.

A typical spray-vacuum cleaning system uses a source of high pressure washing and/or rinsing cleaning liquid, such as would generally be held in a tank and pressurized by conventional pump means. Valve means is then used to selectively control discharge of the liquid from the tank to a cleaning tool for washing and rinsing the surface to be cleaned. Also, a source of vacuum is typically provided, such as at the inlet of a conventional blower. An on-off switch would generally be used to power the blower motor to control the blower operation. A wand is used for communicating the vacuum sourse to the tool itself, which is typically carried at the free end of the wand. The disclosed invention relates to an improved spray-vacuum tool particularly effective to clean wall and/or floor surfaces, of varying materials including nonabsorbent composition or ceramic tile, cement block, or even glass, and of varying degrees of smoothness including those even having patterned holes or grout seams.

FIG. 1 illustrates a wand 10 holding a tool 12, with the sources of liquid and vacuum also being identified. A trigger control 14 is shown on the wand 10 and would be connected to the valve means in the liquid line 16 extending between the source of the high pressure liquid and the tool 12. As noted, the sources of the high pressure liquid and vacuum are conventional, and usually are provided in a wheeled cart having the liquid tank and pump, and having the vacuum blower and its powering motor. An on-off switch on the unit typically controls the operation of the pump and blower motors. None of these components are illustrated herein.

The improved tool 12 has a housing 18 with spaced front and rear side walls **20*f* and 20*r*, respectively and top and end walls 22 extending between and interconnecting the side walls, so as to define together an interior cavity that is open along one face 24. A partition 25 divides the cavity into adjacent liquid and vacuum chambers 26 and 28 respectively, each open to the single open housing faces 24. A pair of squeegees 30*f* and 30*r* are secured to the housing side walls 20*f* and 20*r*, as by screws 33, and project beyond the open housing face 24, so as to be parallel to the partition 25. Each squeegee 30*f* and 30*r* has a wiping edge 34** that is straight, corresponding to the typically flat overall contour of the surface to be cleaned.

A pair of end guides 38 are also secured to the housing, at the interconnecting end walls 22, and each projects to a flat edge 44 located beyond the open housing face 24. However, the flat edges 44 are somewhat closer to the housing face 24 than the wiping face 34 of the squeegees are. The end guides 38 extend slightly beyond the ends of the squeegees, as at ends **42*f* and 42*r* (see FIG. 5), and the squeegees extend at their ends to fit substantially flush against the flat inside faces of the end guides. Small notches 45 are formed if each flat edge 44**; and the flat edges of the end guides are adapted to fit flush against the surface to be cleaned.

With this end guide-squeegee configuration, the squeegee edges 34 and the end guide edges 44 simultaneously will contact the surface to be cleaned only when the squeegees are somewhat flexed (as is illustrated in FIG. 4) to be in a good wiping orientation relative to the surface to be cleaned. With the end guides 38 and squeegees **30*f* and 30*r* all engaging the surface to be cleaned, they together define an extension of the housing cavity and operate both to isolate the liquid and vacuum chambers 26 and 28** interiorly of the tool, and to communicate the chambers together in the region adjacent the surfaces to be cleaned.

Nozzle means 48 are in the liquid chamber 26, being connected to the liquid line 16, and operate to spray the cleaning liquid directly against the surface to be cleaned. A brush 50 is supported in the liquid chamber 26 of the housing, immediately adjacent the squeegee **30*f*, and has approximately the same, but not more, projection from the open face 24 of the housing that the squeegee 30*f*** has; and thus is likewise adapted to engage the surface to be cleaned.

In the disclosed embodiment, the wand 10 is received in a tubular sleeve 60 of the housing and held axially therein by a swivel connection including a pin 62 formed on the tool sleeve and trapped in a circumferential slot 63 formed in the wand; with the end of the wand then also being close to and probably contacting a stop 64 formed on the sleeve 60. This allows free swivelling of the tool about the axis of the sleeve, while also providing a relatively nonwobbling fit between the tool and the wand.

Figure 6:
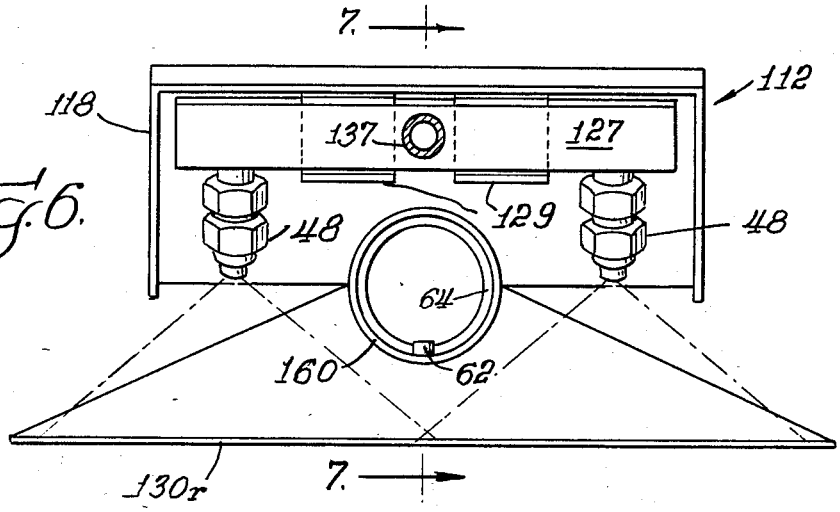
FIG. 6 is a rear elevational view, similar to FIG. 3, of a different tool particularly suited for cleaning carpet, and again being partly broken away and in section for clarity of disclosure.
Figure 7:
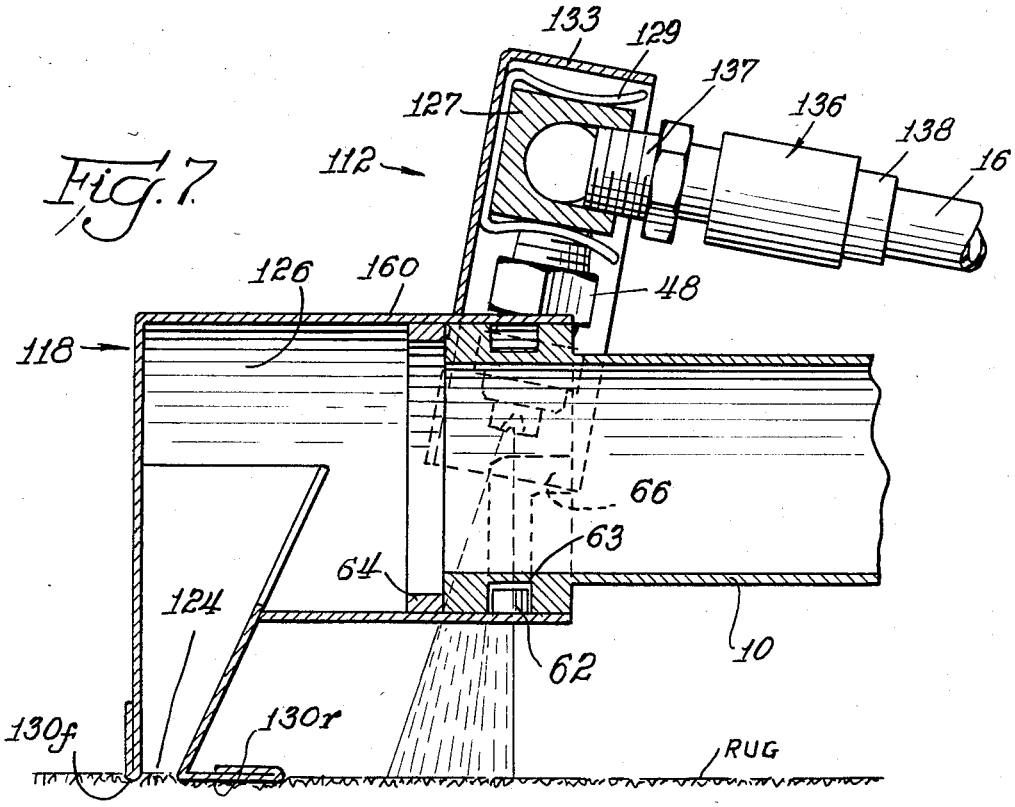
FIG. 7 is a sectional view, as seen generally from line 7—7 in FIG. 6.

The tool is designed to be removable from the wand 10 to allow the wand and its connected spray-vacuum system to be used with other compatible tools: as disclosed in FIGS. 6 and 7 herein, and as disclosed in my cofiled application entitled Liquid-Vacuum Washer for Baseboard Corner. To accomodate this, an axial slot 66 is also formed in the wand extending to the circumferential slot 63, to allow the pin 62 to be passed along this slot to or from the circumferential slot. To minimize accidential disengagement of the tool from the wand, the pin 62 cooperates with the axial slot 66 only when the tool is rotated about the axis of the sleeve almost 180 degrees from its normal in-use orientation relative to the wand.

The end guides 38 are supported relative to the tool housing by a single mounting bolt 68 threated into a tap in the housing and through a pivot hole in the end guide. Stops 69 are on the housing wall 22 spaced slightly above the adjacent surface 70 of each end guide. This allows each end guide to rotate slightly about the mounting bolt 68, until the end guide abuts the stop. This allows the flat edges 44 of the end guides to be held flush against the surface to be cleaned, while having some angular freedom in rotating or rocking the wand slightly up or down, as might occur with normal back-and-forth cleaning strokes; so as to retain suitable vacuum in the vacuum chamber 28. Even during the swivelling of the end guide 38, the ends of the squeegees are yet in sliding contact with the end guide to prevent liquid spray from being discharged beyond the tool containment.

Of great significance to effective tool use is the placement of squeegee **30*f* immediately next to the tool front side; and the slight projection 42*f* of each end guide 38 beyond the squeegee, of the order of between 0.05 and 0.2 inches. This allows the tool placement right up to a corner of the surface being cleaned, with the squeegee 30*f* almost at or in the corner. In this orientation, the spray pattern and brush 50 are at, or can be directed to the corner, by rocking the wand downwardly. Thus, the tool can be moved to fit its front squeegee 30*f*** in the corner and to direct the liquid spray to hit the corner;

and the brush 50 is there also to scrub the corner. The front squeegee 30*f* can then be manipulated, by pressing down on the wand while rocking it slightly upwardly from the spraying orientation, to wipe against the surface to be cleaned; and the rear squeegee 30*r* will also wipe the surface. During all of this wand manipulation, the region over the surface to be cleaned communicates with the vacuum chamber 28 to allow the excess liquid and dirt kicked up by the spraying and brushing to be drawn away. The end guide notches 45 help draw away excess liquid, particularly from the juncture of the surface and any surface transverse thereto; and the roughness on the edge 44 helps dislodge stuck-on dirt clumps from the surface or in the juncture.

Also of great significance to the effective and almost effortless cleaning of a hard surface with this tool 12 is the containment of the cleaning and rinsing liquid proximate the surface to be cleaned. This is made possible by the simultaneous contacting of the end guides 38 and squeegees 30*f* and 30*r* with the surface to be cleaned, and by the containment extension the end guides and squeegees make with the tool housing cavity. Also, the squeegees seating flush against the flat inside faces of the end guides make this contained space quite splash-proof in minimixing or even preventing spray discharge beyond the containment.

As noted, this tool 12 is compatible with other tools, including carpet tool 112 in FIGS. 6 and 7 and the corner-cleaning tool disclosed in my cofiled application. The tool 112 has a housing 118 that defines vacuum chamber 126, and spaced housing surfaces 130*f* and 130*r* that ride on the carpet and define a throat opening 124 that communicates the chamber with the carpet. The wand 10 fits within and locks in a swivelling manner relative to the tool sleeve 160 exactly as the tool 12 does. Also, nozzle means 48 are connected off the liquid line 16 for spraying the cleaning liquid against the carpet; but the spray discharge is made in the open atmosphere on the wand or rear side of the vacuum chamber throat 124.

Of interest to this invention is the fact that the nozzles 48 are mounted from a manifold tube 127 releasibly held relative to either tool 12 or tool 112 by spring fingers 129. In the tool 12, the nozzles are fitted through openings 131 in the top wall 22, and the spring fingers 129 are open upwardly to allow the nozzles to be inserted downwardly through these openings. In the tool 112, the spring fingers 129 are open rearwardly connected off upstanding wall 132; and a top wall 133 overlies the manifold tube 127 to minimize the possibility of it being dislodged during actual tool use.

The widths of the tools need not be the same, and in fact the surface tool 12 might be perhaps 14" wide and carpet tool 112 might be perhaps only 11" wide. To provide full-width coverage of the discharged cleaning liquid with the same nozzles 48, the height of the nozzles above the surface or carpet will be different . . . tool 12 having slightly higher mounted nozzles.

As the corner tool disclosed in my cofiled application is small and uses only a single nozzle, and in order to utilize the same wand, a conventional two-part quick disconnect coupling 136 is provided in the liquid line 16. Thus, one coupling part 137 can be threaded into the manifold tube 127 to remain with the tool, and the other part 138 can be secured on the liquid line 16 to remain with the line. The same wand 10 can be mechanically connected to all such tools, and can be connected to the sources of liquid and of vacuum and used for thereby making the tools and the spray-vacuum system more economical and versatile.

It will be appreciated that this tool 12 is most effective in cleaning a hard surface, such as ceramic or composition tile, cement or cement block, and even glass; and in cleaning smooth or rough surfaces, including those having patterned holes or grooves, or grouted regions in the surface. This cleaning is improved because of the direct spraying and brushing action against the surface, and because the spray takes place within the confined cavity region of the housing directly over the surface to be cleaned. Moreover, inasmuch as the vacuum and liquid chambers are interconnected via this cavity containment, any dirt or debris kicked up with the spray can be immediately drawn away through the vacuum chamber and related vacuum system. The end guide cutouts 45 allow effective liquid removal, such as from corners. Further, the squeegees and end guides contain the spray to prevent it from spreading out beyond the tool itself; and the squeeges act equally well in wiping the surface upon tool movement in either a forward or rearward direction. The effective cleaning action and the effective liquid retaining and drying action allows the tool to clean the surface with few repeat strokes over the surface; providing a real saving in time and effort. This will be particularly beneficial in the commercial cleaning service industry, and for cleaning hard surfaces.

What I claim for my invention:

1. For use with a spray-vacuum cleaning system having a source of high pressure cleaning liquid and a source of vacuum, and including a wand for communicating the vacuum source to the tool, an improved spray-vacuum tool to clean a hard generally flat surface such as bare tile, cement, or even glass, comprising the combination of a housing open-sided on one face and defining an interior cavity, and a partition dividing the cavity into adjacent liquid and vacuum chambers each open to the open housing face;

a pair of squeegees secured to and projected beyond the open housing face from opposite housing sides paralleling the partition;

each squeegee having a substantially straight wiping edge;

a pair of end guides also secured to and projected beyond the open housing face from the other interconnecting housing sides;

said end guides also extending slightly beyond the ends of the squeegees and the squeegees extending at their ends flush against the end guides;

said end guides projecting from the housing somewhat less than do the squeegees, and the end guides each having a flat edge adapted to be fitted flush against the surface to be cleaned, whereupon the squeegees simultaneously contact the surface to be cleaned and are then somewhat flexed;

the end guides and squeegees being operable together then to isolate the chambers from the exterior of the cleaning tool while communicating the chambers together in the region adjacent the surface to be cleaned;

nozzle means in the liquid chamber operable to spray the washing and/or rinsing liquid directly against the surface to be cleaned; and means to connect the hollow wand relative to the housing and to communicate the source of the vacuum with the vacuum chamber.

2. A cleaning tool according to the combination of claim 1, further including a brush supported in the liquid chamber of the housing cavity immediately adjacent the squeegee and adapted to engage the surface to be cleaned.

3. A cleaning tool according to the combination of claim 2, wherein each of said end guides is mounted to the housing by a single mounting bolt that allows the end guide to swivel slightly while being retained with its flat edge against the surface to be cleaned.

4. A cleaning tool according to the combination of claim 3, wherein the end guides project beyond each of the squeegees a distance of the order of 0.05–0.2 of an inch.

5. A cleaning tool according to the combination of claim 3, wherein the front squeegee is disposed closely proximate the front side wall of the tool to allow the tool to be moved immediately next to any wall angled transverse to the surface being cleaned.

6. A cleaning tool according to the combination of claim 3 further including a stop carried on the housing adjacent the end guide operable when butted by the end guide to limit the degree of swivel of the end guide.

7. A cleaning tool according to the combination of claim 3, further including a brush supported in the liquid chamber of the housing cavity immediately adjacent the squeegee, said brush having the same projection from the open housing face as does the squeegee and adapted also then to engage the surface to be cleaned.

8. A cleaning tool according to the combination of claim 3, further including notches formed in each flat edge of the end guides.

9. A cleaning tool according to the combination of claim 8, further including a stop carried on the housing adjacent the end guide operable when butted by the end guide to limit the degree of swivel of the end guide.

10. A cleaning tool according to the combination of claim 9, further including a brush supported in the liquid chamber of the housing cavity immediately adjacent the squeegee, said brush having the same projection from the open housing face as does the squeegee and adapted also then to engage the surface to be cleaned.

11. A cleaning tool according to the combination of claim 10, wherein the end guides project beyond each of the squeegees a distance of the order of 0.05–0.2 of an inch.

12. A cleaning tool according to the combination of claim 10, further including means to releasably mount the want relative to the tool, and elongated manifold means supporting the nozzle means, clamp means in the tool operable to releasably mount the manifold relative to the tool, and means including a valve control and a flexible liquid line on the wand connected between the source of the cleaning liquid and the manifold, whereby the nozzle means can be removed from the tool and the same wand, and nozzle and control valve means can be used with other spray-vacuum tools.

13. A cleaning tool according to the combination of claim 12, further including a quick disconnect coupling provided in the liquid line off of the manifold and having a part remaining with the wand and a part remaining with the manifold, operable to be compatible with other spray-vacuum tools.

* * * * *